US007896282B2

(12) United States Patent
Barea

(10) Patent No.: US 7,896,282 B2
(45) Date of Patent: Mar. 1, 2011

(54) DOUBLE CONTROL LOOP METHOD AND DEVICE FOR ENSURING CONSTANT TENSION YARN FEED TO A TEXTILE MACHINE

(75) Inventor: Tiziano Barea, Busto Arsizio (IT)

(73) Assignee: B.T.S.R. International S.p.A., Olgiate Olona (IT)

( * ) Notice: Subject to any disclaimer, the term of this patent is extended or adjusted under 35 U.S.C. 154(b) by 0 days.

(21) Appl. No.: 11/994,157

(22) PCT Filed: Jun. 26, 2006

(86) PCT No.: PCT/EP2006/006139
§ 371 (c)(1),
(2), (4) Date: Dec. 28, 2007

(87) PCT Pub. No.: WO2007/006411
PCT Pub. Date: Jan. 18, 2007

(65) Prior Publication Data

US 2008/0210804 A1 Sep. 4, 2008

(30) Foreign Application Priority Data

Jul. 12, 2005 (IT) ..... MI2005A1325

(51) Int. Cl.
*B65H 59/18* (2006.01)
*B65H 59/38* (2006.01)

(52) U.S. Cl. ..... 242/418; 242/419.8; 242/563; 242/564.3

(58) Field of Classification Search ..... 242/416, 242/418, 418.1, 419, 419.1, 419.8, 420, 420.5, 242/420.6, 365.6, 365.7, 563, 564.3, 564.4; 66/146; 226/24, 25; 28/194
See application file for complete search history.

(56) References Cited

U.S. PATENT DOCUMENTS

| | | | |
|---|---|---|---|
| 3,858,416 | A | 1/1975 | White et al. |
| 4,666,096 | A | 5/1987 | Heel et al. |
| 5,280,713 | A | 1/1994 | Hansen et al. |
| 6,079,656 | A | 6/2000 | Schmodde et al. |

FOREIGN PATENT DOCUMENTS

| | | | |
|---|---|---|---|
| EP | 0 489 307 | A1 | 6/1992 |
| WO | WO 03093550 | A1 * | 11/2003 |

* cited by examiner

*Primary Examiner* — William E Dondero
(74) *Attorney, Agent, or Firm* — Cozen O'Connor

(57) ABSTRACT

A method for feeding a yarn (F) under constant tension to a yarn processing point of a textile machine (T) distant from spool (2) or equivalent support from which the yarn (F) unwinds, the tension of said yarn (F) being controlled in proximity to the spool (2) such that this parameter is monitored and controlled immediately after the yarn (F) has been unwound from the spool (2), the yarn (F) fed to the textile machine (T) cooperating, before reaching said processing point on the machine (T), with a series of thread guide elements (8) which modify the tension of the regulated tension. A second tension control is effected in proximity to the textile machine (T), said control being used for further adjustment of the tension of the yarn (F) in proximity to the spool (2) to hence regulate the tension of the yarn (F) entering the machine (T) to a predetermined constant value.

16 Claims, 2 Drawing Sheets

Figure 1:
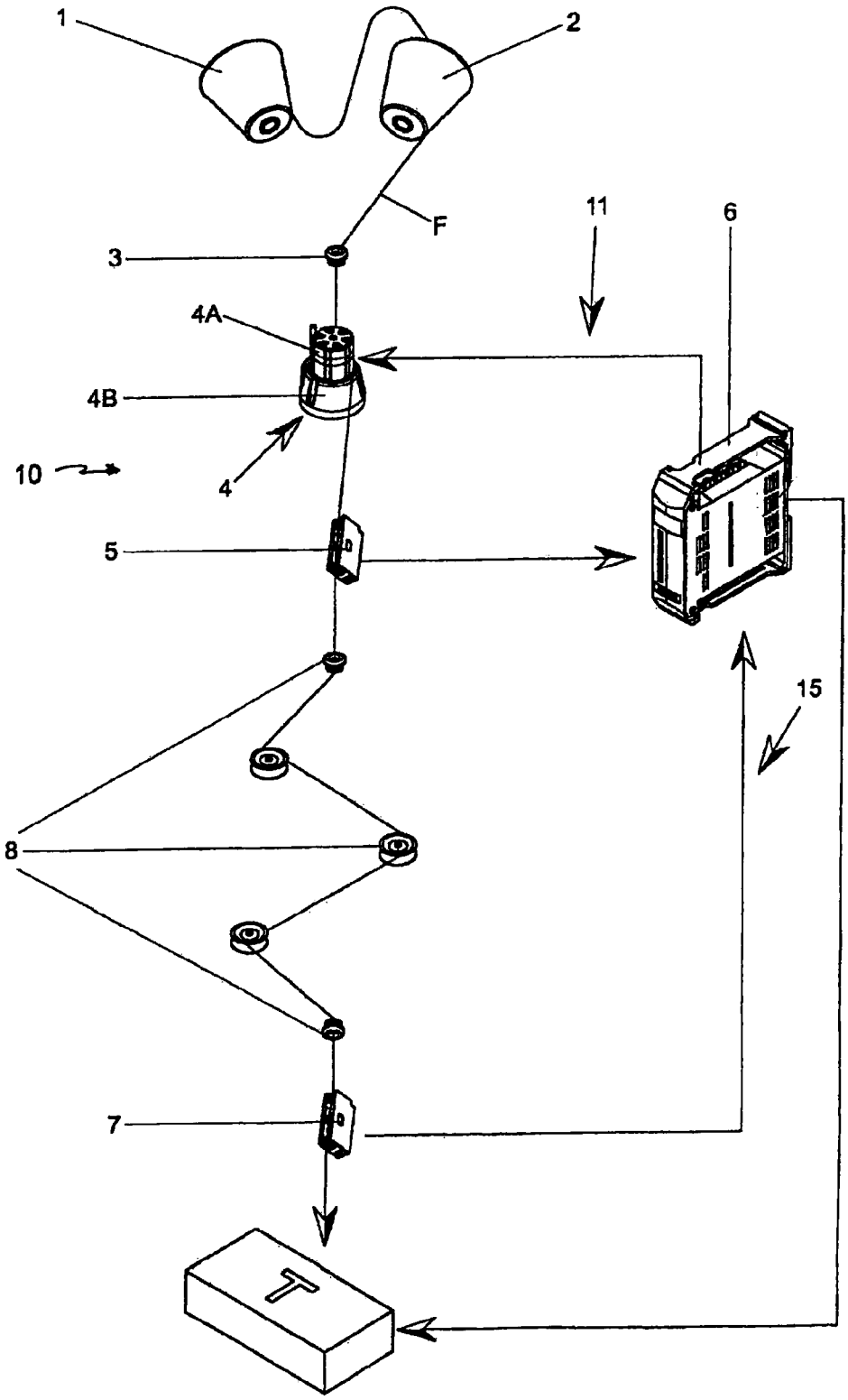

DOUBLE CONTROL LOOP METHOD AND DEVICE FOR ENSURING CONSTANT TENSION YARN FEED TO A TEXTILE MACHINE

The present invention relates to a method and device for feeding a yarn to a textile machine under constant tension.

A yarn used by a textile machine to produce an article must preferably be fed to the machine under constant tension or constant velocity to allow defect-free production. For this purpose, devices are already known for achieving at least constant tension feed: these devices operate using a tension sensor cooperating with the yarn and connected to an electronic circuit usually comprising a microprocessor control unit, in order to provide yarn tension data in real time. The control unit receives the tension data measured by the sensor and compares them with a programmable predetermined tension value (or set point value); on the basis of this comparison, which takes place in accordance with predetermined algorithms (for example a usual PID or proportional-integral-derivative algorithm), the control unit acts on a controlled member cooperating with the yarn, to modify the yarn tension if necessary. For example, the controlled member may be a yarn brake or a rotor driven by its own electric motor controlled by said control unit.

As stated, these devices are commonly used to guarantee the quality of a textile production process by virtue of their capacity to ensure yarn feed to a textile machine under constant tension in real time.

However devices of the aforesaid type are of limited use when the distance between the spool from which the yarn unwinds and the working point or region on the textile machine is such (for example greater than one meter and up to ten meters) that the yarn has to cooperate with a plurality of deviation or thread guide members before reaching the machine. This cooperation means that the yarn undergoes direction and angle changes and is subject to friction which negatively affects its tension (regulated and maintained constant) after its unwinding from the spool and in proximity to this latter. Consequently the yarn entering the textile machine does not present the required tension, but generally presents a tension higher than or otherwise different from that required, with production quality consequences.

The aforegoing certainly applies to the case of textile machines for diaper production in which the spool of each yarn used may be at several meters from the machine (or rather from its productive part) and said yarn cooperates with several guide members before reaching the machine.

In these diaper production machines there is also the problem that the tension of the yarns (usually elastomeric fibres) fed to the machine production region cannot be guaranteed constant and homogeneous because of the manner in which the yarn is fed to this region. In this respect, these machines use yarn feed systems of "rolling takeoff" type, i.e. the type in which the yarn is unwound from its spool by rotating this latter about its axis, such systems ensuring constant velocity feed but not constant tension feed because of their nature.

In addition, these systems cannot accommodate yarn feed by the "head-tail" method because of the spool rotation about its axis. This affects the efficiency and production of the machine, which lacks operational continuity due to the need to halt it periodically to replace empty spools.

U.S. Pat. No. 6,676,054 describes a method for unwinding a yarn from a spool by the "over end takeoff" method using the head-tail method. This is achieved by special positioning of the spool from which each yarn unwinds, relative to a corresponding thread guide member. Said patent however does not describe any problem relative to the tension change which said yarn undergoes because of the distance between the spool and the region or point of its insertion into the textile machine process to which this yarn is fed, nor suggests any yarn control solution to maintain the tension of the yarn entering the machine production region constant, in particular a diaper production machine.

As an alternative to the "rolling takeoff" method for unwinding the yarn from the relative spool, the "over end takeoff" method is also known, by which the yarn is withdrawn from its spool without this latter moving about its axis. This known manner allows both head-tail feed and enables a constant tension to be maintained for the yarn unwound from the spool and fed to the textile machine.

However, this known method for feeding yarn to a textile machine, as in the case of that previously stated, enables the yarn tension to be monitored and controlled only after being unwound from the relative spool and in proximity thereto, because for obvious space reasons or for technical/physical reasons regarding the operation of the components used for their implementation, said devices are compelled to operate in strict contact with the spool (in the "rolling takeoff" case) or in proximity to it (in the "over end takeoff" case).

Hence neither of the methods ensures constant homogeneous tension of the yarn entering the textile machine in that region thereof in which each yarn is taken up by machine members to enable its use in producing an article.

An object of the present invention is therefore to provide a method and relative device by which the aforesaid limits of known methods for feeding yarn to a textile machine are overcome.

Another object is to provide a method and device of the aforesaid type by which a yarn can be reliably fed under constant tension to a textile machine even when the distance between this latter and the spool from which the yarn is unwound is large, for example equal to or greater than several meters. even tens of meters.

Another object is to provide a method and device of the aforesaid type by which any friction problems arising between the spool and the textile machine are eliminated.

A further object is to provide a method and corresponding device which enable the head-tail yarn feed method to be used and still maintain homogeneous constant tension of the yarn entering the textile machine.

A further object is to provide a method and corresponding device by which any yarn running problems over guide and/or deviation members such as thread guides, pulleys and the like can be identified and controlled.

Another object is to provide a method and device of the aforesaid type allowing rapid and repetitive setting of the yarn working tension, i.e. the tension with which each yarn is used by the textile machine, in particular at that point in which the yarn enters the machine, and enabling articles to be produced under working parameters which can be recalled in the case of repetition of the same production process even after considerable time.

These and further objects which will be apparent to the expert of the art are attained by a method and device in accordance with the accompanying claims.

Figure 2:
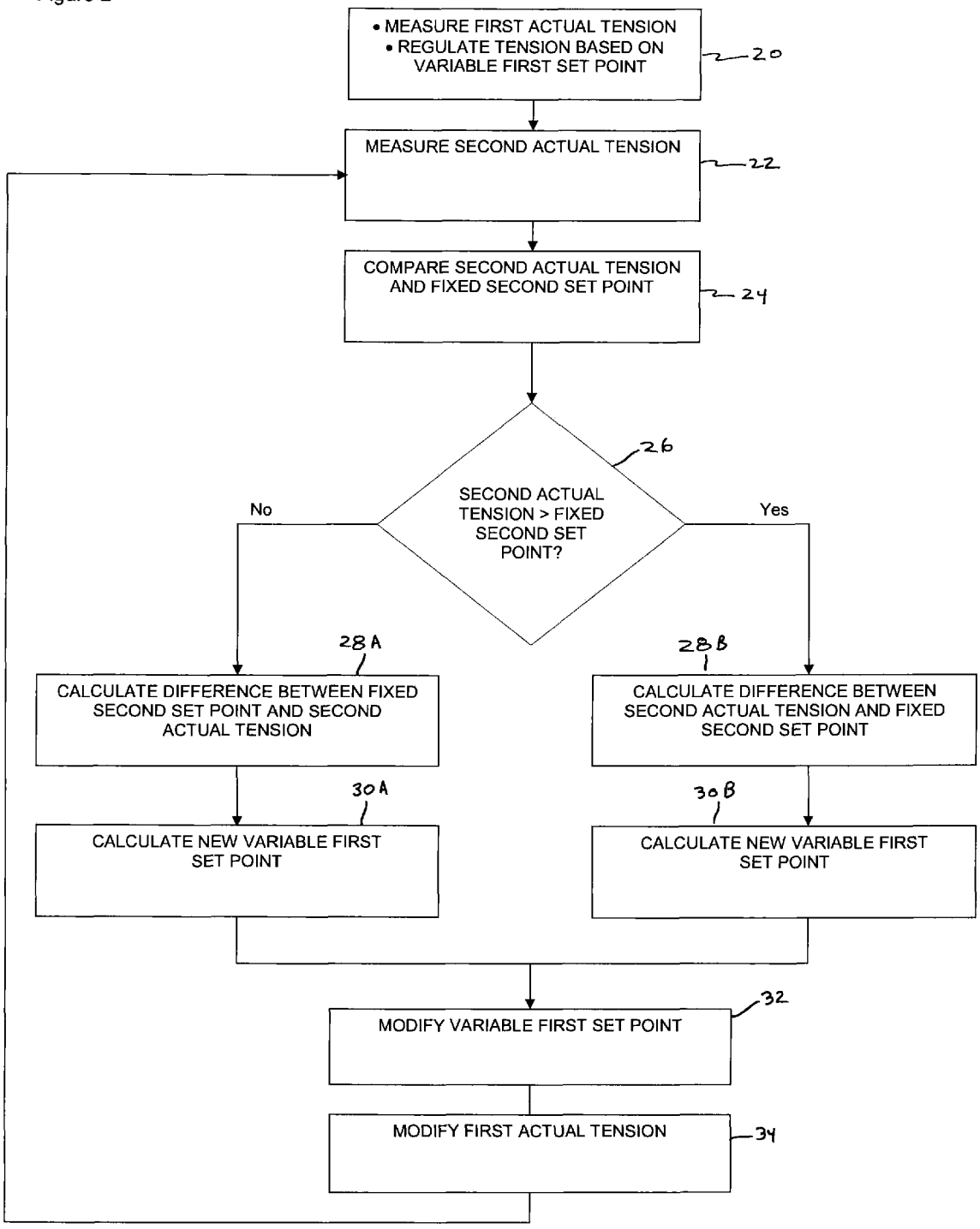

The present invention will be more apparent from the accompanying drawings, which are provided by way of non-limiting example and in which:

FIG. 1 is a schematic view of apparatus in accordance with the invention; and FIG. 2 is a flow diagram showing a method in accordance with the invention.

With reference to FIG. 1 a device of the invention is used to control the feed of a yarn F to a textile machine T, for example a diaper production machine, i.e. a textile machine in which each spool from which a corresponding yarn worked by said machine unwinds is positioned at a distance which can vary from one meter to several tens of meters.

After leaving the spool 2, the yarn F passes through a usual thread guide 3 preferably positioned in front of the two spools 1 and 2 such that both the axes of said spool coincide with the centre of the thread guide to allow regular switch-over and unwinding of the two spools when the first is empty. After cooperating with the thread guide 3, the yarn F cooperates with the device 10 for measuring and regulating its tension. This device 10, of known type, comprises in the example shown in the figure a tension regulator member 4 comprising a rotary element 4A on which the yarn F sides driven by its own electric motor 4B, for example of brushless type, and a usual tension sensor 5. These components 4 and 5 of the device 10 are connected to a control circuit or unit preferably of microprocessor type 6 which, on the basis of tension data measured by the sensor 5 and in accordance with the predetermined control algorithm, compares each measured item of data with predetermined homogeneous data (defining a set point 1) and in case of difference between said data acts on the member 4 (in particular on said electric motor 4B) such that this latter brakes or slows down its action on the yarn F to make the tension measured by the sensor 5 equal to the memorized tension values.

The member 4, the sensor 5 and the unit 6 define a first yarn tension control loop 11 with very rapid intervention times, of the order of tens of nanoseconds or microseconds. This is because the first control loop has to intervene immediately as soon as the sensor 5 senses an undesired variation in the tension of the yarns F, this variation occurring naturally during unwinding of the yarn from the spool 2 because of tugging of the yarn on this latter or deriving from the progressive emptying of the spool.

In textile machines of the aforesaid type operating on a plurality of yarns, each being preferably guided from the corresponding spool to the machine by the use of a plurality of thread guide members 8 which by interacting with the yarn modify its trajectory of movement and spatial angulation. This interaction creates friction which can modify in a more or less considerable manner the tension of the yarn between the spool and the machine, and which can negatively influence the article produced by the machine.

To overcome this problem, the device of the invention is proposed, in which a second yarn tension control loop is present comprising a second tension sensor 7 positioned spaced from the first sensor 5 and in particular positioned in proximity to that region in which the yarn F is withdrawn by usual textile machine withdrawal members (not shown) for its processing.

This second sensor 7 is also connected to the control circuit or unit 6 (acting on the rotary member 4 or rather on its motor 4B) and defines therewith the second yarn tension control loop. However, according to this loop, the unit 6 operates on the basis of predetermined tension values defining the set point 2. On starting the textile machine, the set point 1 must be made to coincide with the set point 2; however the set point of the first control loop can change during machine use as indicated hereinafter, whereas the set point 2 remains constant.

In this respect, during textile machine operation, the first control loop 11 controls and regulates the tension of the yarn unwinding from the spool 2, in known manner. During yarn feed to the textile machine T, the second sensor feeds tension data obtained by it to the unit 6 which, on the basis of these and of a predetermined operative algorithm, compares them with the set point 2. In the case of discrepancy between the measured data (showing a tension greater than the predetermined tension) and the programmed data (set point 2), the unit 6 acts on the first control loop 11 to modify the set point 1 by decreasing it to essentially modify the intervention of the member 4 on the yarn F. This intervention is made to give a suitable tension to the yarn such that its tension is correct when it reaches the second sensor 7.

It should be noted that the intervention times of the second control loop are different from those of the first loop and very much longer, of the order of milliseconds. This is to prevent the system defined by the two control loops from becoming unstable because of a quick intervention time for the second loop. In other words, the intervention time of the second control loop is sufficiently long to enable the tension adjustment made by the first loop on the basis of the data obtained from the second tension sensor 7 to be effectively sensed by this latter.

The intervention speed of each control loop is evidently the speed of execution of the corresponding control algorithm by the unit 6 and hence the speed of intervention of the tension regulator member 4.

The device of the invention is of self-adapting type in that, having fixed the set point 1 for the initial tension regulation of the yarn F, and the value of the set point 2, which instead remains fixed for the entire time for which the textile machine is in use, the device enables the tension of the yarn F entering the textile machine to be corrected totally automatically, independently of the spool from which the yarn originates (even after change-over between spool 2 and spool 1).

Referring to FIG. 2 which is a flowchart showing a method in accordance with the invention, at step 20, at the start of machine operation, a first actual tension in yarn F is measured (by tension sensor 5) at a first location proximate to the region at which the yarn is unwound from the spool 2 and the tension is regulated (by tension regulator member 4) to substantially equal a predetermined variable first set point. As the machine operates, at step 22, a second actual tension in yarn F is measured (by tension sensor 7) at a second location proximate to the region at which the yarn enters the textile machine for processing. At step 24, the second actual yarn tension is compared (by control unit 6) to a predetermined fixed second set point. At step 26, if the fixed second set point is greater than the second actual yarn tension, the difference is calculated at step 28A and a new first variable set point is calculated at step 30A. Similarly, at step 26, if the fixed second set point is less than the second actual yarn tension, the difference is calculated at step 28B and a new first variable set point is calculated at step 30B. At step 32, the variable first set point is modified based on the difference between the second actual yarn tension and the fixed second set point and, at step 34, the tension at the first location proximate to the region at which the yarn is unwound from the spool is modified based on the modified variable first set point. The method repeats after the tension at the first location is modified by returning to step 22.

The device of the invention, which operates in accordance with the aforedescribed modalities and hence the aforesaid manner, also enables various degrees of alarm and pre-alarm to be obtained: if the second sensor 7 senses too high a yarn tension exceeding the value of set point 2, the unit 6 activates a pre-alarm warning of known type (for example a visual alarm) after a predetermined number of failed control attempts. If the tension measured by the sensor 7 nearly reaches a prechosen very high value (beyond which experience or strength tests suggest that yarn breakage or article quality problems are possible), the unit 6 activates an alarm signal and halts the textile machine. This prevents production of defective articles, whereas in the first case (pre-alarm) it allows intervention to solve the problem causing said drop in yarn tension: generally this can also be due to dust or dirt accumulating on the members 8, this dirt being easily removable by a machine operator.

By virtue of the said tension control on the yarn entering the textile machine, the invention enables faults in the thread guides or crossings of different yarns to be determined, and which can cause undesirable modifications (increases) in the tension of the yarn, which would essentially undergo breakage in its movement towards the textile machine.

It is therefore possible by virtue of the invention to maintain the tension of the yarn F entering the machine T at a constant value equal to a desired predetermined value independently of the distance between the first control loop for the tension of said yarn (close to the spool from which the yarn unwinds) form the machine. This ensures constant quality of the article produced by said machine.

The invention also enables the head-tail method for feeding the yarn to the textile machine to be effectively used, so preventing undesirable costly stoppages (in particular in the case of a diaper production machine) and increasing machine productivity.

In addition, by storing in the unit 6 the tension data measured on the yarn used in a particular production, this production can be easily and rapidly repeated. The unit 6 controlling the member 4 can measure the velocity of the yarn fed to the textile machine, the current absorbed by the motor of the member 4 and the torque used, and enables minimum and maximum thresholds for these parameters to be fixed, outside which a risk of obtaining products of quality not corresponding to that required can be identified or predicted.

One embodiment of the invention has been described, but others can be provided in the light of the present description, such as one in which thread guide members are not provided between the sensor 5 and the sensor 7 (even though the distance between these is considerable and exceeds one meter).

The invention claimed is:

1. Apparatus for controlling the tension in a yarn, comprising:

first means for measuring a first actual tension in a yarn at a first location proximate to a first region at which the yarn is unwound from a spool;

means for regulating the first actual tension in the yarn at the first location to substantially equal a variable first set point;

second means for measuring a second actual tension in the yearn at a second location proximate to a second region, distant from the first region, at which the yarn enters a textile machine for processing;

means for comparing and calculating a difference, if any, between said second actual tension in the yarn at the second location and a predetermined fixed second set point; and means for modifying the first variable set point based on the difference, if any, between the second actual tension in the yarn and the second fixed predetermined set point so that said means for regulating the first actual tension in the yarn at the first location modifies the first actual tension in the yarn such that the value of the second actual tension of the yarn at the second location is substantially equal to the second fixed predetermined set point.

2. An apparatus as claimed in claim 1, wherein said first measuring means and said regulating means include a first tension sensor and a tension regulator member respectively, said second measuring means comprise a second tension sensor, said first and second tension sensors being both connected to a control unit comprising comparator means for controlling the regulator member during the use of the textile machine on the basis of a comparison made between the second actual tension measured by the second tension sensor on the yarn at the second location and the predetermined fixed second set point during the use of the machine.

3. An apparatus as claimed in claim 2, wherein the first tension sensor, the regulator member and the control unit define a first yarn tension control loop, and wherein the second tension sensor and said comparator unit define a second yarn tension control loop, and wherein said second loop has prominence over the first loop.

4. An apparatus as claimed in claim 3, wherein said first control loop presents shorter intervention times than the second control loop.

5. An apparatus as claimed in claim 4, wherein the intervention times of the first control loop are between a few milliseconds and a few nanoseconds, and wherein the intervention times of the second control loop are on the order of milliseconds.

6. An apparatus as claimed in claim 2, wherein said control unit controls at least one of the following parameters: the current delivered to said tension regulator member, the torque applied by said tension regulator member to the yarn and the velocity of the yarn feed to the textile machine; said control unit enabling minimum and maximum threshold values to be defined for the parameter under control in order to be able to identify or predict the production of an article of less than acceptable quality.

7. An apparatus as claimed in claim 1, wherein said second region at which the yarn enters the textile machine lies at a distance greater than one meter from said first region at which the yarn is unwound from the spool and from the first measuring and regulating means.

8. An apparatus as claimed in claim 7, wherein said second region lies more than 10 meters from said first region.

9. An apparatus as claimed in claim 1, wherein at least one thread guide modifying the direction and/or angulation of movement of the yarn is present between said first measuring means and said regulator means on one hand and the second measuring means on the other hand.

10. A method for controlling the tension in a yarn comprising the steps of:

measuring a first actual tension in a yarn at a first location proximate to a first region at which the yarn is unwound from a spool;

regulating the first actual tension in the yarn at the first location to substantially equal a predetermined variable first set point;

measuring a second actual tension in the yarn at a second location proximate to a second region, distant from said first region, at which the yarn enters a textile machine for processing;

comparing and calculating a difference, if any, between said second actual tension in the yarn at the second location and a predetermined fixed second set point; and based on the difference, if any, between the second actual tension in the yarn and said second fixed predetermined set point, modifying the first variable set point in a manner calculated to modify said first actual tension in said yarn at said first location so that the value of the second actual tension of the yarn at the second location is substantially equal to the second fixed predetermined set point.

11. A method as claimed in claim 10, wherein said variable first set point is predetermined at the commencement of use of the textile machine.

12. A method as claimed in claim 10 wherein said steps define two closed control loops for yarn feed from said first region at which the yarn is unwound from a spool to said second region at which the yarn enters the textile machine, namely, a first loop being provided at said first location proximate to said first region and the second loop being based on tension data measured on the yarn at said second location in proximity to said second region, said second loop operating on the basis of said predetermined fixed second set point, whereas the first loop operates on the basis of said second tension measured in the yarn at said second location.

13. A method as claimed in claim 10, wherein said first actual tension and said second actual tension are substantially equal at the commencement of use of the textile machine.

14. A method as claimed in claim 10 including the steps of generating an alarm signal when the difference, if any, between said second actual yarn tension and said predetermined fixed second set point, does not decrease following a predefined number of modifications of said first variable set point and of said first actual yarn tension.

15. A method as claimed in claim 14, including the steps of halting the textile machine if the second actual tension of the yarn does not reach a predetermined value.

16. A method as claimed in claim 10, wherein the frequency of yarn intervention based on said variable first set point is less than the frequency of the yarn intervention based on said comparison of said fixed second set point and said second actual yarn tension.

* * * * *